US006382447B1

(12) United States Patent
Loeschen

(10) Patent No.: US 6,382,447 B1
(45) Date of Patent: May 7, 2002

(54) PACKAGING CONTAINER WITH MITERED END CLOSURE

(75) Inventor: Michael D. Loeschen, Evanston, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/736,643

(22) Filed: Dec. 13, 2000

(51) Int. Cl.[7] ..... B05D 43/14

(52) U.S. Cl. ..... 220/4.01; 220/315; 220/810; 220/DIG. 25; 229/125.22; 206/446

(58) Field of Search ..... 220/4.01, 315, 220/810, DIG. 25; 229/125.22; 206/446

(56) References Cited

U.S. PATENT DOCUMENTS 1,069,021 A * 7/1913 Miller ..... 206/446
1,758,230 A * 5/1930 Lange
1,871,888 A * 8/1932 Johnson ..... 206/446
2,194,669 A * 3/1940 Mumford
2,317,884 A * 4/1943 Clouston ..... 229/125.22
2,731,167 A * 1/1956 Moore ..... 220/DIG. 25
3,543,994 A * 12/1970 Clark
3,669,338 A * 6/1972 Cornell et al. ..... 229/DIG. 4
4,607,750 A * 8/1986 Valenti ..... 206/446
4,629,069 A * 12/1986 Dugh ..... 206/446
4,662,512 A * 5/1987 Durand ..... 206/446
4,976,374 A * 12/1990 Macaluso ..... 229/125.22

* cited by examiner

*Primary Examiner*—Joseph M. Moy
(74) *Attorney, Agent, or Firm*—Donald J. Breh; Mark W. Croll; Lisa M. Soltis

(57) ABSTRACT

A packaging container is formed from preformed, rigid base and cover units of U-shaped cross-section, the cover unit configured so that the side walls fit within and are embraced by the side walls of the base unit when assembled as a container. The base unit forms an end closure from first and second closure panels extending from an end of the base unit. The closure panels are separated from the base unit and each other by first and second fold lines. The base unit side walls having mitered corners at a juncture with the first closure panel and the first closure panel side walls have mitered corners adjacent the base unit for forming a square comer when folded. The first closure panel side walls also have mitered corners adjacent the second closure panel and the second closure panel side walls have mitered corners adjacent the first closure panel for forming a square corner when folded to form the end closure.

10 Claims, 2 Drawing Sheets

PACKAGING CONTAINER WITH MITERED END CLOSURE

BACKGROUND OF THE INVENTION

This invention pertains to packaging and more particularly to a packaging container having readily sealable, mitered end closures.

Packaging for lengthy items has taken many forms. One construction includes a pair of corrugated, laminated paperboard top and bottom U-shaped channels configured for one to fit within the other. In such an arrangement, one form of end cap includes a fitting that inserts into the open ends of the assembly of the U-shaped channels.

The end caps take numerous forms. In one form, a wooden block sized to snuggly fit within the opening is urged, e.g., forced, into the opening. In another configuration, one of the top and bottom U-shaped channels has a notch cut into opposing side walls of the "U", and the "U" portion is folded over 90°. In such a configuration, the ends of the channels are closed by the folded base portion and the side walls of the "U" as folded over the adjacent side walls. To further seal the package of this configuration, tape or a like strip-type adhesive sealant is extended over the flaps that are folded over the adjacent side walls. Configurations such as these are disclosed in U.S. Pat. No. 4,976,374 which patent is incorporated herein by reference.

Although there are many different types of package constructions that can be used for safely packaging lengthy items, it has been found that these corrugated U-channels provide a number of advantages over prior known packages. For example, these packages have a high strength-to-weight ratio. In addition, they are made from readily available materials and can be recycled. Moreover, these packages are formed from sufficiently durable materials such that they can, to a limited extent, be used more than once.

One drawback to these materials, however, is the end closure. As described above, in one form, the closure itself is formed, in part, from the package material. However, a sealant such as tape or the like is required to wrap around the package in order to assure that the end closure remains closed. In addition, even when the seal is formed, there may remain an opening at the juncture of the folded over base portion and the cover portion. This, as well as the tape sealant that is used to join the packaging sections provides a weak link, as well as additional materials that are necessary for using such packages.

Accordingly there exists a need for a configuration of packaging container in which the entirety of the end cap or end closure is formed from the packaging material itself. Desirably, in such a packaging arrangement, the end cap or closure is readily sealed using commonly available materials and is sealed in a manner that provides a high degree of structural strength and package integrity. Most desirably, such an end closure provides no gaps at the location of the closure.

BRIEF SUMMARY OF THE INVENTION

A packaging container is formed having integral end closures. The container includes a preformed, rigid base unit of U-shaped cross-section having a bottom wall and opposing side walls and a preformed, rigid cover unit of U-shaped cross-section having, a top wall and opposing side walls. The cover unit is configured so that the side walls of the cover unit are fitted within and embraced by the side walls of the base unit when the base unit and cover unit are assembled as a container.

The base unit forms an end closure for the packaging container. The end closure is formed from a first closure panel extending from and adjacent an end of the base unit, and a second closure panel extending from and adjacent an end of the first closure panel. The base unit and first closure panel are separated from one another by a first fold line. The first closure panel and the second closure panel are separated from one another by a second fold line.

The base unit side walls have mitered corners at a juncture with the first closure panel and the first closure panel side walls having first mitered corners adjacent the base unit. Preferably, the mitered corners are formed complementary to one another so that when folded, a square comer is formed. The first closure panel side walls having second mitered corners adjacent the second closure panel and the second closure panel side walls having mitered corners adjacent the first closure panel. Preferably, once again, the mitered corners are formed complementary to one another so that when folded, a square comer is formed. Most preferred, all of the mitered corners are formed at an angle of about 45 degrees.

The first closure panel is configured for folding generally perpendicular to the base unit bottom wall and the second closure panel is configured for folding generally perpendicular to the first closure panel, generally parallel to the base unit bottom wall and abutting the cover unit top wall.

When folded, the first mitered corners of the first closure panel abut the mitered corners of the base unit side walls, and second mitered corners of the first closure panel abut the mitered corners of the second closure panel. This forms the end closure.

In a present embodiment, the base unit side walls have a height that is about equal to the height of the second closure panel side walls. In this embodiment, the first closure panels have a height that is about one-half of the height of the base unit side walls. In this manner, when folded, the second closure panels insert between the base unit and cover unit side walls to secure the package closed.

Alternately, the second closure panel side walls are formed having second mitered corners. In this configuration, the second closure panel does not insert between the cover unit and base unit side walls, but abuts the side wall mitered corners.

A present packaging container includes two end closures.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
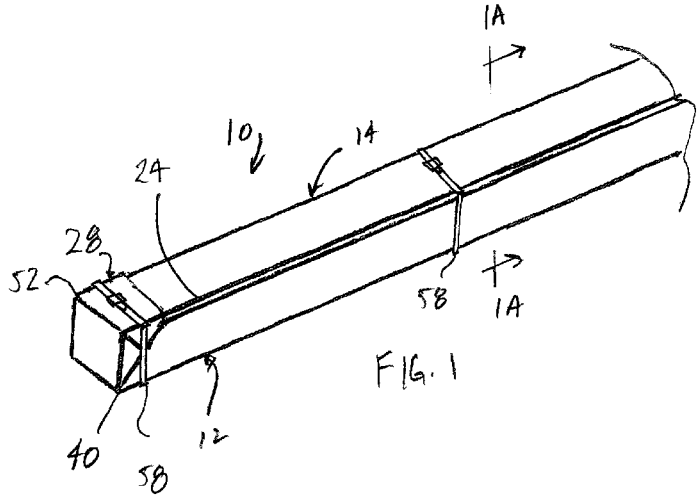
FIG. 1 is a partial perspective view of an embodiment of a packaging container with mitered end closures constructed in accordance with the principles of the present invention, the container being shown in the fully constructed or assembled form and further shown with wire-ties securing the packaging container closed.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a packaging container 10 embodying the principles of the present invention. The packaging container 10 includes a base unit 12 and a cover unit 14. Each the base unit 12 and cover unit 14 is formed from a laminated U-shaped cross-section of paperboard material. The base unit 12 includes a top wall 16 and side walls 18. The cover unit 14 includes a top wall 22 and side walls 24. The above-noted U.S. Pat. No. 4,976,374 discloses such a construction.

Figure 1A:
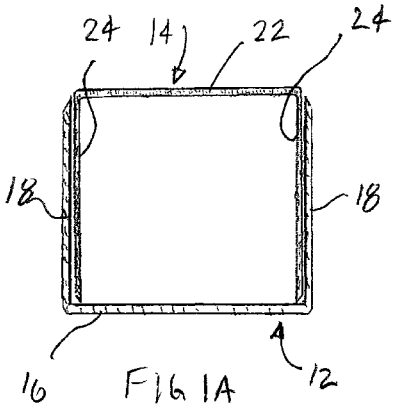
FIG. 1A is a cross-sectional view of the constructed container taken along line 1A—1A of FIG. 1.

As seen in FIG. 1A, the base unit 12 and cover unit 14 are sized so that upon assembly into a container the side walls 24 of the cover unit 14 fit within the side walls 18 of the base unit 12. As will be recognized by those skilled in the art, the packaging container 10 can be "flipped over" in which case the side walls of the base will fit within the side walls of the cover.

Figure 2:
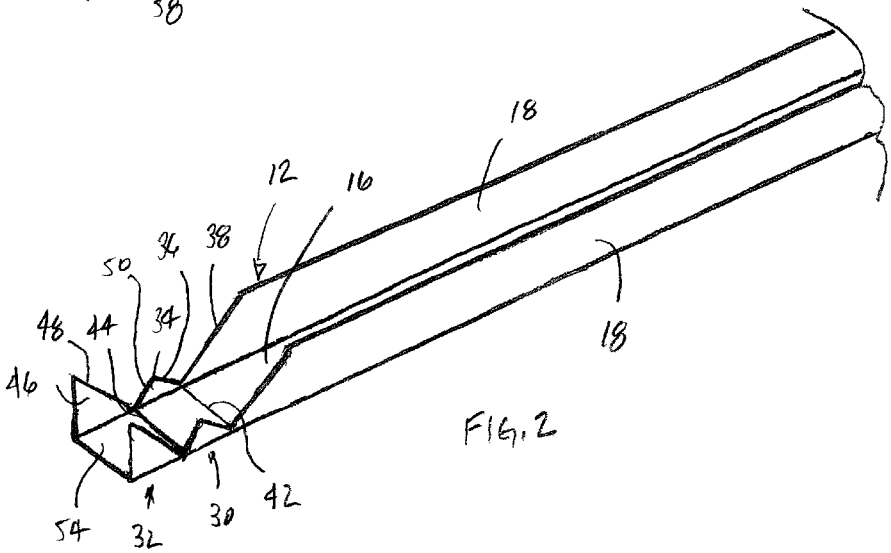
FIG. 2 is a partial perspective view of one embodiment of the base unit of the packaging container with the first and second closure panels laid open, prior to folding and securing.

The packaging container 10 includes a novel end cap or closure 28 configuration, as shown in FIGS. 1 and 2. The closure 28 configuration includes first and second mitered closure panels 30, 32 formed from an extension of the base unit 12. For purposes of the present disclosure, the closure panels 30, 32 will be presented as part of the base unit 12. However, as will be recognized by those skilled in the art from ail examination of the drawings, the closure panels 30, 32 can be formed as part of the cover unit 14 when the cover unit 14 has a wider cross-section than that of the base unit 12. Both of these configurations are within the scope and spirit of the present invention.

Figure 3:
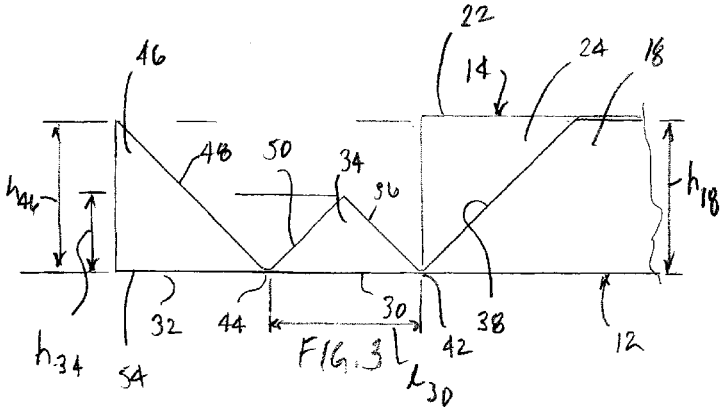
FIG. 3 is a side view of the base unit end closure of FIG. 2 shown for clarity and discussion of the closure panels.

The first panel 30 is formed in the base unit 12 adjacent the location in the base unit 12 corresponding to the end of the cover unit 14 (see FIG. 3). The side walls 34 of the first panel 30 have first mitered corners, as indicated at 36, as do the base unit side walls 18, as indicated at 38, immediately adjacent to the first panel mitered corners 36. Preferably, the first panel mitered corners 36 and the base unit mitered corners 38 are complementary to one another. In this manner, as will be discussed below, when the end closure 28 is folded or formed, the first panel first mitered corners 36 and the base unit side wall mitered corners 38 fit together (e.g., abut one another) to form a square or 90 degree comer as indicated at 40. A first fold line or crease 42 can be formed in the base unit bottom wall 16 at the juncture of the mitered corners 36 38 to facilitate this folding.

The base unit 12 second closure panel 32 is adjacent the first closure panel 30. The second closure panel 32 is separated from the first panel 30 by a second fold or crease line 44 formed in the bottom wall 16, parallel to the first fold line 42. The side walls 46 of the second closure panel 32 include mitered corners 48 at the juncture with the first closure panel 30. To this end, the side walls 34 of the first closure panel 30 include second mitered corners 50 adjacent the second closure panel 32. In this arrangement, as seen in FIGS. 2 and 3, the base unit side walls 18, the first closure panel side walls 34 (on both sides) and the second closure panel side walls 46 each have mitered corners at their respective, adjacent junctures. Preferably, the first panel second mitered corners 50 and second panel mitered corners 48 are complementary to one another so that, as will be discussed below, when the end closure 28 is folded or formed, the second panel mitered corners 48 and the first panel second mitered corners 50 fit together (e.g., abut one another) to form a square or ninety degree comer as indicated at 52.

Referring to FIG. 3, it will be seen that the length $l_{30}$ of the first panel 30 is about equal to the height $h_{18}$ of the side walls 18 of the base unit 12 (which is about equal to the height of the side walls 24 of the cover unit 14). As such, because of the double mitered corners 36, 50 of the first panel 30, the height $h_{34}$ of the side walls 34 of the first panel 30 at their respective peaks is about one-half of the height $h_{18}$ of the side walls 18 of base unit 12. The height $h_{46}$ of the side walls 46 of the second panels 32, at their peak or greatest height, is less than or equal to the height $h_{18}$ of the base unit side walls 18. This, as will be described below, facilitates tucking the second panel side walls 46 between the side walls 18 of the base unit 12 and the side walls 24 of the cover unit 14 when the closure 28 is formed.

Figure 4A:
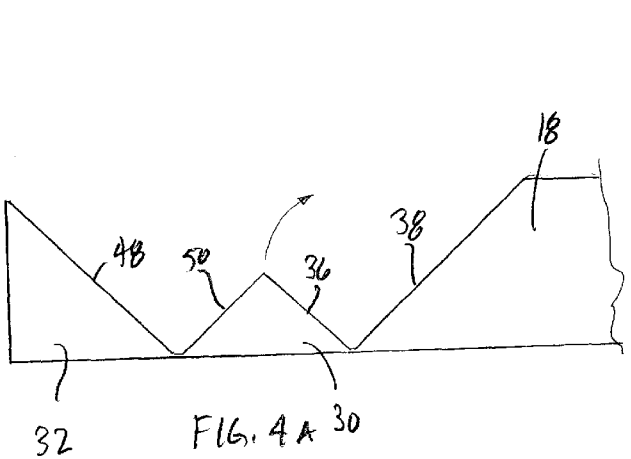
FIGS. 4A–4C illustrate the folding of the end closure of FIGS. 2 and 3.
Figure 4B:
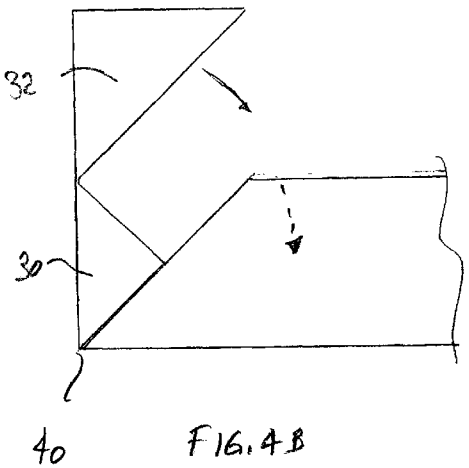
Figure 4C:
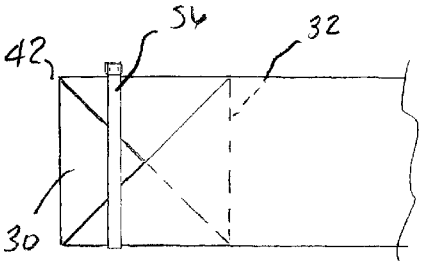

Referring to FIGS. 4A–4C, assembling the package 10 is straightforward and readily carried out. The base unit 12 is placed on a surface, with the first and second closure panels 30, 32 laid out flat. The articles to be packaged are placed in the base unit 12 and the cover unit 14 is placed over the articles with the cover unit side walls 24 inside of and abutting the base unit side walls 18. The ends of the cover unit 14 are aligned with the base unit first fold line 42.

The first panel 30 is then folded upwardly, so that the first panel 30 is perpendicular to the bottom wall 16 of the base unit 12. The second panel 32 is then folded over, perpendicular to the first panel 30, so that the bottom wall 54 of the second panel 32 lies against the cover unit top wall 22. As the second panel 32 is folded over the cover unit 14, the second panel side walls 46 can be inserted or tucked between cover unit side walls 24 and the base unit side walls 18. This provides an essentially self-contained package 10.

A band or like element 58, such as a wire-tie can then be positioned encircling the closure 28, over and around the second panel 32 and the base unit side walls 18 and bottom wall 16, thus providing the sealed package 10. In this manner, where the closure 28 is fully folded, it forms a sleeve, providing additional strength to the packaging container 10, with an increased overall wall thickness at the sleeve. This high strength, easily formed closure 28 has no openings or gaps between the walls forming the package 10 that could otherwise compromise the integrity and strength of the package 10.

In addition, because the package 10 can be sealed using a non-adhesive element (such as the exemplary band or wire-tie 58), it is readily reusable. Known packages that require sealing with an adhesive such as tape, will typically have one or more layers of the paperboard laminate remove when removing the "old" tape. In that the present package 10 can be sealed without an adhesive, i.e., with a band, the reusability of the package 10 is greatly increased.

As will be recognized from a study of the drawings, each of the mitered corners 36, 38, 48, 50 is shown being formed at an angle of about 45 degrees. This facilitates cutting the side walls 18, 34, 46, in that all of the wall angles are the same, and further assures that the mitered corners are complementary (i.e., form square 90 degree corners 40, 52). It will, however, be recognized by those skilled in the art that the angles need not be 45 degrees, and that other combinations of angles can be used to provide the square corners 40, 52. All such other angle combinations are within the scope and spirit of the present invention.

Figure 5A:
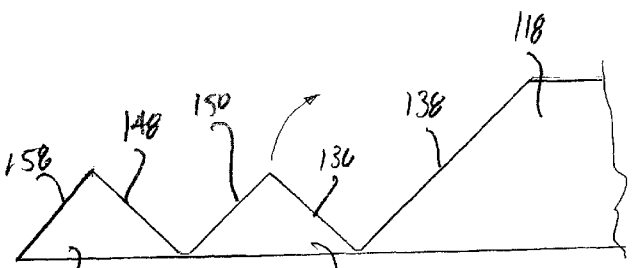
FIGS. 5A–5C illustrate the folding and sealing of an alternate embodiment of the packaging container end closure.
Figure 5B:
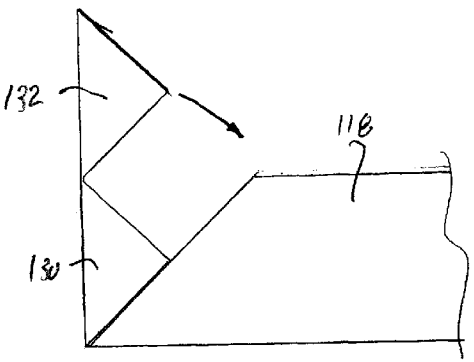
Figure 5C:
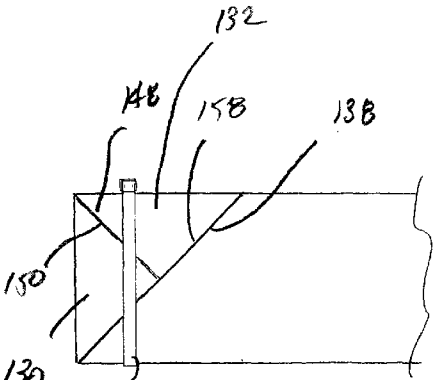

Alternately, as shown in FIGS. 5A–5C, the side walls of the second closure panel 146 can be cut or formed having a second mitered corner, as indicated at 160. In such an arrangement, rather than the second panel side walls 146 inserting between the respective side walls 118, 124 of the base and cover units 112, 114, the side walls 146 of the second closure panel 132 mate, in a complimentary manner, with the mitered corners of the base unit side walls 138. Again, a strap or like fastener 58 can then be positioned around the second closure panel 132 and the base unit 118 to seal the package 110.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. The packaging container comprising:

a preformed, rigid base unit of U-shaped cross-section having a bottom wall and opposing side walls; and a preformed, rigid cover unit of U-shaped cross-section having a top wall and opposing side walls, the cover unit configured so that the side walls of the cover unit are fitted within and embraced by the side walls of the base unit when the base unit and cover unit are assembled as a container, the base unit forming an end closure for the packaging container formed from a first closure panel extending from and adjacent an end of the base unit, and a second closure panel extending from and adjacent an end of the first closure panel, the base unit and first closure panel being separated from one another by a firs fold line, the first closure panel and the second closure panel being separated from one another by a second fold line, the base unit side walls having mitered corners at a junction with the first closure panel and the first closure panel side walls having first mitered corners adjacent the base unit, the first closure panel side walls having second mitered corners adjacent the second closure panel and the second closure panel side walls having mitered corners adjacent the first closure panel, the first closure panel being configured for folding generally perpendicular to the base unit bottom wall and the second closure panel being configured for folding generally perpendicular to the first closure panel generally parallel to the base unit bottom wall and abutting the cover unit top wall, wherein the first mitered corners of the first closure panel abut the mitered corners of the base unit side walls, and second mitered corners of the first closure panel abut the mitered corners of the second closure panel forming the end closure.

2. The packaging container in accordance with claim 1 wherein the base unit side walls have a height that is about equal to a height of the second closure panel side walls.

3. The packaging container in accordance with claim 1 wherein the base unit side walls have a height and wherein the first closure panels have a height that is about one-half of the height of the base unit side walls.

4. The packaging container in accordance with claim 2 wherein the base unit side walls have a height and wherein the first closure panels have a height that is about one-half of the height of the base unit side walls.

5. The packaging container in accordance with claim 1 wherein the first mitered corners of the first closure panel and the mitered corners of the base unit are complementary to one another.

6. The packaging container in accordance with claim 1 wherein the second mitered corners of the first closure panel and the mitered corners of the second closure panel are complementary to one another.

7. The packaging container in accordance with claim 1 wherein the mitered corners of the base unit, the first mitered corners of the first closure panel, the second mitered corners of the first closure panel, and the mitered corners of the second closure panel are formed at an angle of about 45 degrees.

8. The packaging container in accordance with claim 1 wherein the base unit side walls have a height, and wherein the second closure panel side walls are formed having second mitered corners, and wherein the second closure panel side walls have a height that is about one-half of the height of the base unit side walls.

9. The packaging container in accordance with claim 1 wherein the second closure panel side walls are configured for insertion between the base unit side walls and the cover unit side walls when the end closure is formed.

10. The packaging container in accordance with claim 1 wherein the base unit includes two end closures, each positioned at an end of the base unit.

* * * * *